US005096876A

United States Patent [19]

Jahn et al.

[11] Patent Number: 5,096,876

[45] Date of Patent: Mar. 17, 1992

[54] IMAGE RECEIVING MATERIAL FOR DYE DIFFUSION THERMAL TRANSFER

[75] Inventors: Reiner Jahn; Horst Westfal, both of Belm, Fed. Rep. of Germany

[73] Assignee: Felix Schoeller jr. GmbH & Co. KG, Osnabruck, Fed. Rep. of Germany

[21] Appl. No.: 572,498

[22] Filed: Aug. 23, 1990

[30] Foreign Application Priority Data

Sep. 28, 1989 [DE] Fed. Rep. of Germany ..... 3932419

[51] Int. Cl.[5] ..... B41M 5/035; B41M 5/26

[52] U.S. Cl. ..... 503/227; 8/471; 428/195; 428/211; 428/342; 428/511; 428/513; 428/913; 428/914; 503/227

[58] Field of Search ..... 8/471; 428/195, 211, 428/342, 500, 507, 511, 513, 913, 914; 503/227

[56] References Cited

U.S. PATENT DOCUMENTS 4,916,112 4/1990 Henzel et al. ..... 503/227

FOREIGN PATENT DOCUMENTS 1211256 9/1986 Canada ..... 503/227

3244355 6/1984 Fed. Rep. of Germany ..... 503/227

*Primary Examiner*—Bruce H. Hess

*Attorney, Agent, or Firm*—Lockwood, Alex, FitzGibbon & Cummings

[57] ABSTRACT

The invention relates to image receiving material for dye diffusion thermal transfer comprising a polyolefin coated base paper the front side of which has been coated with a receiving layer which comprises a combination of an acrylate copolymer containing polar groups and an oxidized polyethylene as a dye receiving resin.

19 Claims, No Drawings

IMAGE RECEIVING MATERIAL FOR DYE DIFFUSION THERMAL TRANSFER

BACKGROUND AND DESCRIPTION OF THE INVENTION

The invention relates to an image receiving material for dye diffusion thermal transfer, as well as a process for its manufacture.

A system of dye diffusion thermal transfer ("D2T2") has been developed in recent years which makes possible the reproduction of an electronically created picture in the form of a "hardcopy". The principle of D2T2 is that, with regard to the basic colors cyan, magenta red, yellow and black, the digital picture is encoded into electrical signals which are then transmitted to a thermal printer and translated into heat. The dye of the donor layer of a dye transfer band/sheet which is in contact with the receiving material sublimates under the effect of heat and diffuses into the receiving layer.

As a rule, a receiving material for dye diffusion thermal transfer comprises a support material with a receiving layer applied to its front side. Additionally other layers may be applied onto the front side, such as barrier, release, adhesive and protective layers. The necessity of such additional coatings is required by the demands placed upon the receiving material. These may be:

a smooth surface
heat and pressure stability
light stability (no yellowing)
good dye solvency
good anti-scratch and abrasion characteristics
"anti-blocking" characteristics (no sticking)

Either plastic foils such as polyester film or coated paper may serve as the support material.

The main component of the receiving layer is, as a rule, thermoplastic resin showing an affinity to the dye contained in the dye transfer band. Materials suitable for such may be linear polyesters, e.g. polyethylene terephthalate, polybutylene terephthalate or acrylic resins, e.g. polymethylmethacrylate, polybutylmethacrylate, polymethylacrylate etc. Furthermore, such materials as polystyrene, polycarbonate, polyvinyl pyrrolidone, ethyl cellulose, polysulfone and other polymers may be used as dye receiving resins.

U.S. Pat. Nos. 4,748,150 and 4,774,224 show that polycarbonate may be used as a receiving layer on a polyethylene coated base paper. Moreover, an intermediate layer is applied between the support material and the receiving layer. This intermediate layer is a vinylidene chloride copolymer and serves to improve adhesion between the receiving layer and the support material. The above mentioned receiving sheet has shown itself to be disadvantageous as the polycarbonate used shows a strong tendency to yellowing and in time affects the transferred picture negatively. A further disadvantage is that both coats must be applied using solvent agents which can lead to health and safety problems.

The problem of pressure sensitivity of the receiving sheet when in contact with the heating head has been dealt with in the European Patent Application EP 0 288 193. This pressure sensitivity makes itself shown in a reduction of the surface gloss of the layer or in the phenomenon "strike-through" in which an impression of the picture can be seen on the reverse side of the receiving sheet. The problem is solved by applying a release layer based on silicone with a $SiO_2$ additive onto a polyester receiving layer which has been coextruded onto a polyester support material. The disadvantage of the above mentioned is that the picture is blurred, probably as a result of a reaction between the reacting groups of the silicone compounds and the diffused dyes in the receiving layer. Furthermore, the similarity to a photo, as required by the market, is missing with pictures produced in this manner.

It is furthermore a fact that dye issuing from the dye donor band and diffused into the receiving layer tends to pale under the influence of light. This problem has been dealt with in the U.S. Pat. No. 4,775,657 in so much as the receiving layer, consisting of polycarbonate, is coated with a protective coating of polyester or polyurethane. A disadvantage of material so produced is the pressure sensitivity of the receiving sheet, as well as the necessity of several work operations and the necessity of using organic solvents during coating.

The Patent Application EP 0 261 970 describes a receiving layer containing a linear saturated polyester as a binding agent and a silica coupled silane copolymer as a release agent (anti-blocking additive).

The object of this invention, therefore, is to provide a receiving material for dye diffusion thermal transfer procedures which does not show the disadvantages as mentioned above, i.e. it must exhibit good heat and light proof characteristics, as well as being impervious to pressure and demonstrates good flatness and antiblocking characteristics. Moreover, the receiving material represents a further improvement of color density and color gradation compared to the receiving sheets already on the market.

The object of the invention is accomplished by coating the front side of polyolefin coated base paper with a receiving coating mass which, as a dye receiving resin, contains a combination of at least one acrylate copolymer polar group and oxidized polyethylene.

It was surprising to find that the utilization of the above mentioned combination created a receiving material which not only met the requirements as previously listed, but at the same time enabled a high color density of the printed image, as well as improving color gradation.

In a preferred embodiment of the invention an acrylate copolymer whose polar groups are carboxyl, metal combined carboxyl groups and/or nitrile groups was utilized. Zinc combined carboxyl groups are especially to be preferred in the metal combined groups.

Acrylonitrile and/or methacrylic acid take part in the structure of the acrylate copolymer used in the combination according to the invention and the amounts of these monomers in the copolymers are between 10 and 40 mol %. In a preferred embodiment the amounts of these monomers are between 25 and 35 mol %. The acrylate copolymer compound may, additionally, contain styrene in an amount of up to 40 mol %.

The weight relationship of the acrylate copolymer to the oxidized polyethylene in the combination according to the invention may be between 99:I and 30:70. The best results, as far as color density and color gradation are concerned, were obtained with acrylate copolymer-/oxidized polyethylene in a weight relationship of between 70:30 and 40:60 (see Example 2, Table 2).

The receiving layer for the receiving sheet according to the invention may contain, as well as the dye receiving resin, fine particled silica or $Al_2O_3$ as a matting agent or further additives, such as fluorine tenside as wetting agents, dispersing agents, dye couplers, UV stabilizers, pigments and other auxilary agents.

The coating mass for the receiving layer may be applied using any of the usual procedures for coating and dosing such as roll gravure, nipcoating, air brushing or wire bar onto a substrate, as for instance polyethylene coated paper. The receiving coating may be applied in an aqueous form in a one step operation. The coating weight of the receiving layer may be between 0.3–15 g/m², but 1–10 g/m² is preferable.

As a support material, a paper with at least one side coated with a polyolefin, such as polyethylene, is preferred, wherein this polyolefin layer applied in accordance to the available coating technology has a basis weight of more than 5 g/m², and preferably between 7–25 g/m².

The polyolefin layer may contain pigments and other additives.

The invention is illustrated in the following examples, although this in no way sets limits to the invention.

EXAMPLE 1

The front side of polyethylene coated base paper, with the basis weight of 180 g/sq m and coated on both sides with polyethylene, was coated with an aqueous dispersion of the following content:

| Product | Content, wt. % | | | |
|---|---|---|---|---|
| | 1A | 1B | 1C | 1D* |
| Acrylate copolymer I, 40% aqueous dispersion | 96.0 | | | 96.0 |
| Acrylate copolymer II, 40% aqueous dispersion | | 96.0 | | |
| Acrylate copolymer III, 38% aqueous dispersion | | | 96.0 | |
| Fluorine tenside, 1% in water | 4.0 | 4.0 | 4.0 | 4.0 |
| Coating weight, g/m² | 5.0 | 5.0 | 5.0 | 5.0 |

*no titanium dioxide in the polyethylene coating.

Other tests conditions were:
Machine speed: 130 m/min
Drying temperature: 110° C.
Drying time: 10 sec The back side of the base paper was coated with clear polyethylene, a mixture of LDPE and HDPE (35% HDPE with a density of d=0.959 g/cm³, MFI=8; 28% HDPE with d=0.950 g/m³, MFI=7; 20% LDPE with d=0.934 g/cm³, MFI=3; 17% LDPE with d=0.915 g/cm³, MFI=8) at a coating weight of between 14–15 g/m².

The front side was coated with a mixture of pigmented polyethylene (19% HDPE with d=0.959 g/cm³, MFI=8; 20% LDPE with d=0.934 g/cm³, MFI=3; 13.3% LDPE with d=0.915 g/cm³, MFI=8; 26.7% LDPE with d=0.924 g/cm³, MFI=4.5; 21% $TiO_2$ masterbatch with a 50% $TiO_2$ content) at a coating weight of 15 g/m².

The acrylate copolymers were copolymers in whose structure polar group containing monomers of the following content were used:

| | |
|---|---|
| Acrylate copolymer I (e.g. Primal HG-44 from Rohm & Haas Ltd.) | 35 mol % |
| Acrylate copolymer II (e.g. Maincote HG-54 from Rohm & Haas Ltd.) | 30 mol % |

An acrylate/styrene copolymer (e.g. NeoCryl SR-205 from Polyvinyl Chemie Ltd., Holland) containing zinc-combined carboxyl groups was used as acrylate copolymer III.

A fluorine tenside (e.g. FT-248 from Bayer AG) was used as a wetting agent.

The receiving material was printed on using the dye diffusion thermal transfer method and subsequently analyzed. The results may be seen as compiled in Table 1.

This example is designed to show the exceptional suitability of the above mentioned acrylate copolymers as components of the invention's receiving layer.

EXAMPLE 2

A support material as in Example 1, except for the front side being polyethylene coated at 7 g/m², was coated with an aqueous dispersion of the following content:

| Product | Content, wt % | | | | | | |
|---|---|---|---|---|---|---|---|
| | 2A | 2B | 2C | 2D | 2E | 2F | 2G |
| Acrylate copolymer I 40% aqueous dispersion (as in Example 1) | 91.7 | 61.4 | 41.4 | — | 41.4 | 41.4 | — |
| Acrylate copolymer III 38% aqueous dispersion (as in Example 1) | — | — | — | — | — | — | 42.4 |
| Oxidized Polyethylene 30% aqueous dispersion (e.g. Südranol 340, from Süddeutsche Emulsionschemie GmbH) | 5.1 | 35.0 | 55.2 | 96.0 | 55.2 | 55.2 | 53.7 |
| 1% Fluorine tenside in water (as in Example 2) | 3.2 | 3.6 | 3.4 | 4.0 | 3.4 | 3.4 | 3.9 |
| Coating weight g/m² | 5.0 | 5.0 | 5.0 | 5.0 | 10.0 | 0.5 | 5.0 |

All other test conditions were identical to Example 1.

The results of the tests of the following printed pictures are to be seen in Table 2.

EXAMPLE 3

A support material as in Example 1 was coated with an aqueous dispersion of the following content:

| Product | Content, wt % | | |
|---|---|---|---|
| | 3A | 3B | 3C |
| Acrylate copolymer I 40% aqueous dispersion (as in Example 1) | 53.8 | 48.4 | 42.7 |
| Oxidized polyethylene 30% aqueous dispersion (as in Example 2) | 27.6 | 32.3 | 28.4 |
| Silica 15% in water (e.g. Syloid ED 50, from Grace GmbH) | 11.1 | — | — |
| $Al_2O_3$, 63% slurry (e.g. Martifin OL-008, from Martinswerk) | — | 15.3 | 13.5 |
| Titanium dioxide 40% in water (e.g. Rutil RN 40 from Kronos Titan) | 4.1 | — | — |
| UV absorber, 15% in water (e.g. Tinuvin 213 from Ciba-Geigy AG) | — | — | 11.8 |
| Fluorine tenside 1% in water (as in example 1) | 3.4 | 4.0 | 3.6 |

-continued

| Product | Content, wt % 3A | 3B | 3C |
|---|---|---|---|
| Coating weight g/m² | 5.0 | 5.0 | 5.0 |

All other test conditions were identical to Example 1. The test results are compiled in Table 3.

COMPARATIVE EXAMPLES

V1. The test was carried out as Example 1. The receiving layer was applied in an aqueous form of the following content:

| Product | Content wt. % V1 A | V1 A |
|---|---|---|
| Acrylate copolymer IV, 50% aqueous dispersion | 96.0 | — |
| Acrylate copolymer V, 40% aqueous dispersion | — | 96.0 |
| Fluorine tenside, 1% in water (as in Example 1) | 4.0 | 4.0 |
| Coating weight, g/m² | 5.0 | 5.0 |

The acrylate copolymers were copolymers in whose structures polar groups containing monomers of the following content were used:

| | |
|---|---|
| Acrylate copolymer IV (e.g. Primal P 376 from Rohm & Haas Company) | 9 mol % |
| Acrylate copolymer V (e.g. Primal WL 91 K from Rohm & Haas Company) | 7 mol % |

The receiving material so produced was then printed upon by means of dye diffusion thermal transfer and then analyzed. The results are compiled in Table 4.

V2. The test was carried out as Example 1. An acryl resin such as polyethyl acrylate (e.g. Plextol B from Rohm Ltd.) was used as dye receiving resin.

The printed pictures so produced (hard copy) were tested and the results of the test may be seen in Table 4.

V3. For comparison purposes, Hitachi image receiving material, as can be found on the market, was used. The results may be seen in Table 4.

TESTING OF THE IMAGE RECEIVING MATERIAL PRODUCED AS PER EXAMPLES 1-3 & V1-V3

The receiving material produced underwent dye diffusion thermal transfer.

A Hitachi color video printer model VY - 25 E together with Hitachi dye ribbon was used. The technical details of the video printer are as follows:

Video memory—Pal 1-full-image memory

Printed image—64 color shade image image elements: 540:620 dots

Printing time—2 minutes/print

The prints so produced (hard copies) were investigated for their color density and anti-blocking characteristics.

The density measurements were taken before and after a 24 hour exposure of the prints to a Xenon lamp. The loss of density thereby caused was measured using, Δd (%) as an evaluation of the light stability.

The equipment used here was an Original Reflection Densitometer SOS-45. The measurements were taken in five color gradations from F1-F5 for the basic colors cyan, magenta, yellow and black, whereby the values for F1, F3 and F5 are given in the tables. The number of possible color gradations from 0-7 is likewise to be found in the tables.

At the same time comparative measurements were taken from receiving materials from the market.

The results to be found in Tables 1-4 show that the receiving material manufactured according to the invention and the images printed on it reflect higher values of color density and color gradation in every color range.

The light stability (Δd-values) also show better values from the material produced according to the invention as do the comparison materials used.

TABLE 1

Characteristics of the Printed Image Receiving Material Produced According to Example 1

| Example | F | Color density d cyan a | cyan b | magenta a | magenta b | yellow a | yellow b | black a | black b | Gradation | "anti" blocking characteristics |
|---|---|---|---|---|---|---|---|---|---|---|---|
| 1A | F1 | 1.54 | 1.40 | 1.29 | 1.19 | 1.43 | 1.39 | 1.39 | 1.46 | 6 | good |
| | F3 | 0.24 | 0.12 | 0.23 | 0.13 | 0.23 | 0.20 | 0.28 | 0.22 | | |
| | F5 | 0.09 | — | 0.09 | — | 0.08 | — | 0.11 | — | | |
| 1B | F1 | 1.64 | 1.49 | 1.31 | 1.24 | 1.48 | 1.45 | 1.47 | 1.52 | 6 | good |
| | F3 | 0.28 | 0.16 | 0.22 | 0.15 | 0.25 | 0.23 | 0.29 | 0.24 | | |
| | F5 | 0.11 | — | 0.09 | — | 0.08 | — | 0.11 | — | | |
| 1C | F1 | 1.38 | 1.25 | 1.15 | 1.06 | 1.14 | 1.11 | 1.30 | 1.29 | 6 | good |
| | F3 | 0.15 | 0.08 | 0.18 | 0.10 | 0.15 | 0.13 | 0.21 | 0.18 | | |
| | F5 | 0.03 | — | 0.06 | — | 0.04 | — | 0.08 | — | | |
| 1D | F1 | 1.51 | 1.40 | 1.26 | 1.15 | 1.42 | 1.36 | 1.37 | 1.38 | 6 | good |
| | F3 | 0.27 | 0.17 | 0.23 | 0.14 | 0.21 | 0.18 | 0.28 | 0.24 | | |
| | F5 | 0.14 | — | 0.12 | — | 0.8 | — | 0.13 | — | | |

a—before exposure to Xenon-lamp
b—after 24 h exposure to Xenon-lamp

TABLE 2

Characteristics of the Printed Image Receiving Material Produced According to Example 2

| Example | F | Color density d cyan a | cyan b | cyan d % | magenta a | magenta b | magenta d % | yellow a | yellow b | yellow d % | black a | black b | black d % | Gradation | "anti" blocking characteristics |
|---|---|---|---|---|---|---|---|---|---|---|---|---|---|---|---|
| 2A | F1 | 1.72 | 1.43 | 16.8 | 1.36 | 1.24 | 8.8 | 1.55 | 1.49 | 3.9 | 1.49 | 1.51 | 0 | 7 | good |

TABLE 2-continued

| Example | F | Characteristics of the Printed Image Receiving Material Produced According to Example 2 | | | | | | | | | | | | | |
|---|---|---|---|---|---|---|---|---|---|---|---|---|---|---|---|
| | | Color density d | | | | | | | | | | | | | |
| | | cyan | | | magenta | | | yellow | | | black | | | Gradation | "anti" blocking characteristics |
| | | a | b | d % | a | b | d % | a | b | d % | a | b | d % | | |
| | F3 | 0.30 | 0.23 | 23.3 | 0.24 | 0.20 | 16.7 | 0.29 | 0.22 | 24.1 | 0.33 | 0.26 | 21.2 | | |
| | F5 | 0.12 | — | — | 0.10 | — | — | 0.12 | — | — | 0.13 | — | — | | |
| 2B | F1 | 1.89 | 1.57 | 16.9 | 1.48 | 1.40 | 5.4 | 1.66 | 1.46 | 12.1 | 1.61 | 1.65 | 0 | 7 | good |
| | F3 | 0.36 | 0.30 | 16.7 | 0.29 | 0.25 | 4.0 | 0.36 | 0.32 | 11.1 | 0.38 | 0.32 | 15.8 | | |
| | F5 | 0.17 | — | — | 0.14 | — | — | 0.17 | — | — | 0.17 | — | — | | |
| 2C | F1 | 2.09 | 1.78 | 14.8 | 1.62 | 1.53 | 5.6 | 1.75 | 1.44 | 17.7 | 1.73 | 1.76 | 0 | 7 | good |
| | F3 | 0.51 | 0.44 | 13.7 | 0.40 | 0.32 | 20.0 | 0.42 | 0.39 | 11.9 | 0.48 | 0.44 | 8.3 | | |
| | F5 | 0.27 | — | — | 0.21 | — | — | 0.22 | — | — | 0.25 | — | — | | |
| 2D | F1 | — | — | — | — | — | — | — | — | — | — | — | — | — | stuck |
| | F3 | | | | | | | | | | | | | | |
| | F5 | | | | | | | | | | | | | | |
| 2E | F1 | 2.05 | 1.80 | 12.2 | 1.65 | 1.56 | 5.5 | 1.73 | 1.44 | 16.8 | 1.75 | 1.76 | 0 | 7 | good |
| | F3 | 0.50 | 0.44 | 12.0 | 0.40 | 0.30 | 10.0 | 0.41 | 0.38 | 7.3 | 0.50 | 0.48 | 4.0 | | |
| | F5 | 0.26 | — | — | 0.20 | — | — | 0.20 | — | — | 0.25 | — | — | | |
| 2F | F1 | 2.01 | 1.78 | 11.4 | 1.62 | 1.55 | 4.3 | 1.75 | 1.53 | 12.6 | 1.73 | 1.75 | 0 | 7 | good |
| | F3 | 0.48 | 0.43 | 10.4 | 0.38 | 0.32 | 15.8 | 0.40 | 0.37 | 7.5 | 0.48 | 0.45 | 6.3 | | |
| | F5 | 0.25 | — | — | 0.21 | — | — | 0.20 | — | — | 0.24 | — | — | | |
| 2G | F1 | 1.84 | 1.56 | 15.2 | 1.52 | 1.44 | 5.3 | 1.35 | 1.22 | 9.6 | 1.75 | 1.75 | 0 | 7 | good |
| | F3 | 0.44 | 0.40 | 9.1 | 0.42 | 0.39 | 7.1 | 0.42 | 0.36 | 14.3 | 0.48 | 0.45 | 6.3 | | |
| | F5 | 0.18 | — | — | 0.19 | — | — | 0.20 | — | — | 0.25 | — | — | | |
| Comparison (Hitachi) | F1 | 1.70 | 1.36 | 20.0 | 1.43 | 1.15 | 19.6 | 1.51 | 1.21 | 19.9 | 1.69 | 1.39 | 17.8 | 6 | good |
| | F3 | 0.28 | 0.21 | 25.0 | 0.35 | 0.26 | 25.7 | 0.43 | 0.33 | 23.3 | 0.44 | 0.33 | 25.0 | | |
| | F5 | 0.09 | — | — | 0.03 | — | — | 0.09 | — | — | 0.08 | — | — | | |

TABLE 3

| Example | F | Characteristics of the Printed Image Receiving Material Produced According to Example 3 | | | | | | | | | | | | | |
|---|---|---|---|---|---|---|---|---|---|---|---|---|---|---|---|
| | | Color density d | | | | | | | | | | | | | |
| | | cyan | | | magenta | | | yellow | | | black | | | Gradation | "anti" blocking characteristics |
| | | a | b | d % | a | b | d % | a | b | d % | a | b | d % | | |
| 3A | F1 | 1.78 | 1.41 | 20.7 | 1.48 | 1.38 | 6.8 | 1.58 | 1.36 | 13.9 | 1.57 | 1.47 | 6.4 | 7 | good |
| | F3 | 0.30 | 0.26 | 13.3 | 0.28 | 0.25 | 10.7 | 0.30 | 0.25 | 16.7 | 0.35 | 0.28 | 20.0 | | |
| | F5 | 0.11 | — | — | 0.12 | — | — | 0.10 | — | — | 0.13 | — | — | | |
| 3B | F1 | 1.79 | 1.51 | 15.6 | 1.41 | 1.34 | 4.9 | 1.57 | 1.43 | 8.9 | 1.52 | 1.55 | 0.0 | 7 | good |
| | F3 | 0.39 | 0.29 | 25.0 | 0.32 | 0.26 | 18.8 | 0.35 | 0.31 | 11.4 | 0.39 | 0.35 | 10.0 | | |
| | F5 | 0.17 | — | — | 0.14 | — | — | 0.17 | — | — | 0.17 | — | — | | |
| 3C | F1 | 1.77 | 1.46 | 17.5 | 1.41 | 1.33 | 5.7 | 1.56 | 1.41 | 9.6 | 1.53 | 1.55 | 0.0 | 7 | good |
| | F3 | 0.39 | 0.25 | 35.9 | 0.33 | 0.26 | 21.2 | 0.36 | 0.32 | 11.1 | 0.40 | 0.35 | 12.5 | | |
| | F5 | 0.18 | — | — | 0.15 | — | — | 0.18 | — | — | 0.20 | — | — | | |
| Comparison (Hitachi) | F1 | 1.70 | 1.36 | 20.0 | 1.43 | 1.15 | 19.6 | 1.51 | 1.21 | 19.9 | 1.69 | 1.39 | 17.8 | 6 | good |
| | F3 | 0.28 | 0.21 | 25.0 | 0.35 | 0.26 | 25.7 | 0.43 | 0.33 | 23.3 | 0.44 | 0.33 | 25.0 | | |
| | F5 | 0.09 | — | — | 0.03 | — | — | 0.09 | — | — | 0.08 | — | — | | |

TABLE 4

| Example | F | Characteristics of the Printed Image Receiving Material Produced According to Examples V1–V3 | | | | | | | | | | | | | |
|---|---|---|---|---|---|---|---|---|---|---|---|---|---|---|---|
| | | Color density d | | | | | | | | | | | | | |
| | | cyan | | | magenta | | | yellow | | | black | | | Gradation | "anti" blocking characteristics |
| | | a | b | d % | a | b | d % | a | b | d % | a | b | d % | | |
| V1 A | | — | — | — | — | — | — | — | — | — | — | — | — | — | stuck |
| V1 B | | — | — | — | — | — | — | — | — | — | — | — | — | — | stuck |
| V2 | F1 | 1.45 | 1.17 | 19.3 | 1.34 | 1.24 | 7.5 | 1.36 | 0.53 | 61.0 | 1.48 | 1.46 | 1.4 | 6 | good |
| | F3 | 0.21 | 0.10 | 52.3 | 0.18 | 0.11 | 38.9 | 0.14 | 0.02 | 85.7 | 0.24 | 0.18 | 25.0 | | |
| | F5 | 0.10 | — | — | 0.10 | — | — | 0.05 | — | — | 0.10 | — | — | | |
| V3 Hitachi-receiving material | F1 | 1.70 | 1.36 | 20.0 | 1.43 | 1.15 | 19.6 | 1.51 | 1.21 | 19.9 | 1.69 | 1.39 | 17.8 | 6 | good |
| | F3 | 0.28 | 0.21 | 25.0 | 0.35 | 0.26 | 25.7 | 0.43 | 0.33 | 23.3 | 0.44 | 0.33 | 25.0 | | |
| | F5 | 0.09 | — | — | 0.03 | — | — | 0.09 | — | — | 0.08 | — | — | | |

We claim:

1. An image receiving material for dye diffusion thermal transfer comprising a resin coated base paper and an image receiving layer comprising a dye receiving resin formed on the front side of said base paper, wherein the dye receiving resin is a combination of at least one acrylate copolymer containing at least one polar group and an oxidized polyethylene.

2. The image receiving material of claim 1, wherein the polar group contained in the acrylate copolymer is selected from the group consisting essentially of carboxyl, metal combined carboxyl, and/or nitrile groups.

3. The image receiving material of claim 2, wherein the metal combined carboxyl group is a zinc combined carboxyl group.

4. The image receiving material of claim 3, wherein the monomers which contain the polar group are acrylonitrile and/or methacrylic acid and the amount of these monomers contained in the copolymer is between 10 and 40 mol %.

5. The image receiving material of claim 4, wherein the content of monomers is between 25 and 35 mol %.

6. The image receiving material of claim 4, wherein the coating weight of the receiving layer is between about 1 and 10 g/m$^2$.

7. The image receiving material of claim 2, wherein the monomers which contain the polar group are acrylonitrile and/or methacrylic acid and the amount of these monomers contained in the copolymer is between 10 and 40 mol %.

8. The image receiving material of claim 7, wherein the content of monomers is between 25 and 35 mol %.

9. The image receiving material of claim 2, wherein the acrylate copolymer additionally contains styrene as a monomer in an amount up to 40 mol %.

10. An image receiving material of claim 1, wherein the monomers which contain the polar group are acrylonitrile and/or methacrylic acid and the amount of these monomers contained in the copolymer is between 10 and 40 mol %.

11. The image receiving material of claim 10, wherein the content of monomers is between 25 and 35 mol %.

12. The image receiving material of claim 10, wherein the acrylate copolymer additionally contains styrene as a monomer in an amount up to 40 mol %.

13. The image receiving material of claim 1, wherein the acrylate copolymer additionally contains styrene as a monomer in an amount up to 40 mol %.

14. The image receiving material of claim 1, wherein the ratio of acrylate copolymer to oxidized polyethylene is between about 99 to 1 and 30 to 70.

15. The image receiving material of claim 14, wherein the ratio of acrylate copolymer to oxidized polyethylene is between about 70 and 30 and 40 to 60.

16. The image receiving material of claim 1, wherein the receiving layer contains additional additives selected from the group consisting of pigments, matting agents, and wetting agents.

17. The image receiving material of claim 1, wherein the coating weight of the receiving layer is between about 0.3 and 15 g/m$^2$.

18. The image receiving material of claim 17, wherein the resin coating of the base paper is polyolefin having a coating weight of at least about 5 g/m$^2$.

19. The image receiving material of claim 1, wherein the resin costing of the base paper is polyolefin having a coating weight of at least about 5 g/m$^2$.

* * * * *

UNITED STATES PATENT AND TRADEMARK OFFICE
CERTIFICATE OF CORRECTION

PATENT NO. : 5,096,876

DATED : March 17, 1992

INVENTOR(S) : Jahn et al.

It is certified that error appears in the above-identified patent and that said Letters Patent is hereby corrected as shown below:

In column 2, line 60, delete "99:I" and insert -- 99:1 --.

In column 10, line 16, claim 16, delete the comma.

In column 10, line 24, claim 19, delete "costing" and insert -- coating --.

Signed and Sealed this

First Day of June, 1993

*Attest:*

*Attesting Officer*

Michael K. Kirk

MICHAEL K. KIRK

*Acting Commissioner of Patents and Trademarks*